US009512743B2

(12) United States Patent
Chern et al.

(10) Patent No.: US 9,512,743 B2
(45) Date of Patent: Dec. 6, 2016

(54) VALVETRAIN IMPACT ABSORBER

(71) Applicant: Ford Global Technologies, LLC, Dearborn, MI (US)

(72) Inventors: Jim Chern, Troy, MI (US); Chong Hsi Jack Chen, Bloomfield Hills, MI (US); Minghui Chien, Farmington Hills, MI (US); Scott Michael DeRaad, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/666,550

(22) Filed: Mar. 24, 2015

(65) Prior Publication Data

US 2015/0192041 A1 Jul. 9, 2015

Related U.S. Application Data

(63) Continuation of application No. 13/791,625, filed on Mar. 8, 2013, now Pat. No. 8,985,077.

(51) Int. Cl.

| | |
|---|---|
| ***F01L 3/10*** | (2006.01) |
| ***F01L 1/16*** | (2006.01) |
| ***F01L 1/14*** | (2006.01) |
| ***F01L 3/20*** | (2006.01) |
| *F01L 1/20* | (2006.01) |

(52) U.S. Cl.

CPC .. *F01L 1/16* (2013.01); *F01L 1/14* (2013.01); *F01L 3/10* (2013.01); *F01L 3/20* (2013.01); *F01L 1/205* (2013.01); *F01L 2820/01* (2013.01)

(58) Field of Classification Search

CPC ..... F01L 1/16; F01L 1/20; F01L 1/205; F01L 1/46; F01L 3/08; F01L 3/10

USPC ..... 123/90.1–90.67

See application file for complete search history.

(56) References Cited

U.S. PATENT DOCUMENTS

| | | | | | |
|---|---|---|---|---|---|
| 2,574,120 | A * | 11/1951 | Rich | F01L 3/10 | 123/90.29 |
| 2,827,029 | A * | 3/1958 | Norton | F01L 1/32 | 123/90.3 |
| 2,999,492 | A * | 9/1961 | Duesenberg | F01L 3/08 | 123/90.37 |
| 3,114,361 | A * | 12/1963 | Mullen | F01L 3/10 | 123/188.1 |
| 3,479,007 | A * | 11/1969 | Buell | F01L 1/12 | 123/188.2 |
| 4,563,984 | A | 1/1986 | Ziegler et al. | | |
| 4,913,106 | A | 4/1990 | Rhoads | | |
| 6,119,645 | A * | 9/2000 | Hesher | F01L 3/08 | 123/188.6 |
| 6,237,550 | B1 * | 5/2001 | Hatano | F01L 9/04 | 123/90.11 |
| 7,552,720 | B2 | 6/2009 | Borg et al. | | |
| 7,575,594 | B2 | 8/2009 | Sieracki | | |
| 7,815,164 | B2 | 10/2010 | Dong et al. | | |

(Continued)

*Primary Examiner* — Jorge Leon, Jr.

(74) *Attorney, Agent, or Firm* — Julia Voutyras; Alleman Hall McCoy Russell & Tuttle LLP

(57) ABSTRACT

Embodiments may provide a valve train for an engine including a valve stem configured for reciprocating movement to open and close a port in a combustion chamber of the engine. The valve train may also include an elastomeric element coupled with the valve stem, and a mass may be coupled with the elastomeric element and able to move relative to the valve stem.

14 Claims, 3 Drawing Sheets

(56) References Cited

U.S. PATENT DOCUMENTS

2012/0090574 A1 4/2012 Sumilla et al.

* cited by examiner

VALVETRAIN IMPACT ABSORBER

CROSS REFERENCE TO RELATED APPLICATIONS

The present application is a continuation of U.S. patent application Ser. No. 13/791,625, entitled "VALVETRAIN IMPACT ABSORBER," filed on Mar. 8, 2013, now U.S. Pat. No. 8,985,077, the entire contents of which are hereby incorporated by reference for all purposes.

FIELD

The present application relates to valve trains and to a valve retainer wherein a mass is coupled to a valve stem via a resilient member.

BACKGROUND

Engines can produce highly audible tick noises. The frequency range of the tick noise may be in the range of several hundred Hz to 15.0 kHz. Interaction between the various components of the engine's valve train has been identified as a possible source of impact noises. A typical engine valve train may include a cam, tappet, valve retainer, valve stem, valve, valve coil spring, and a valve seat. Accordingly, one possible source of impact noise may include impact forces transferred from the tappet to the valve stem when the cam shaft lobe impacts the tappet. For example as the camshaft rotates and the cam lobe hits the tappet; the tappet may in turn hit the valve retainer fastened to the valve stem; the valve may then move to open the intake or exhaust to the combustion chamber. All these transient hits may emit high frequency tick noises from the various structural contacts and may transmit the noise through engine head/block and etc. to magnify tick noises. These tick noises may cover frequencies from 1000 Hz to 20,000 Hz.

Various attempts have been made to make valve train noises less audible. One attempt is disclosed in U.S. Pat. No. 4,563,984. The patent discloses a sleeve apparatus with a first sleeve fitted around an end of an intake pipe to absorb noise vibrations produced by combustion and by operation of the intake air control apparatus, i.e. valve train components, and a second sleeve encapsulating a fuel injection valve to absorb noise vibrations produced by pulsed fuel injection. The sleeve apparatus is located where the intake pipe is coupled with the cylinder head in order to prevent high-frequency pulse-like ticking noises from being reflected by the intake pipe.

The inventors herein have recognized several issues with this approach. For example, the approach only attempts to absorb and insulate the noises that are present and may not reduce the production of the noises.

Embodiments in accordance with the present disclosure may provide a valve train for an engine including a valve stem configured for reciprocating movement to open and close a port in a combustion chamber of the engine. The valve train may also include an elastomeric element coupled with the valve stem. A mass may be coupled with the elastomeric element and may be able to move relative to the valve stem.

Embodiments may include a valve retainer fixed to the valve stem. The elastomeric element may be an annular ring encircling at least a portion of the valve retainer. The mass may be an annular ring encircling at least a portion of the elastomeric element.

Some embodiments may provide a valve train for an engine including a valve stem of a valve movable to open and close a port to a combustion chamber of the engine. A mass may be coupled with the valve stem via a resilient member. In some cases the valve train may include a valve retainer fixed to the valve stem. The valve retainer may have an annular coupling surface. The resilient member may be an elastomeric ring fitted over the annular coupling surface and the mass may be an annular ring compressed over the elastomeric ring.

Some embodiments may provide a valve retainer including a coupling surface. An elastomeric element may be fixed to the coupling surface, and a mass may be over the elastomeric element.

In this way, the mass may tend to mitigate high frequency impact forces, and/or to absorb impact transient forces. In this way the production of noises from the valve train, in particular noises within particular frequency ranges, may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
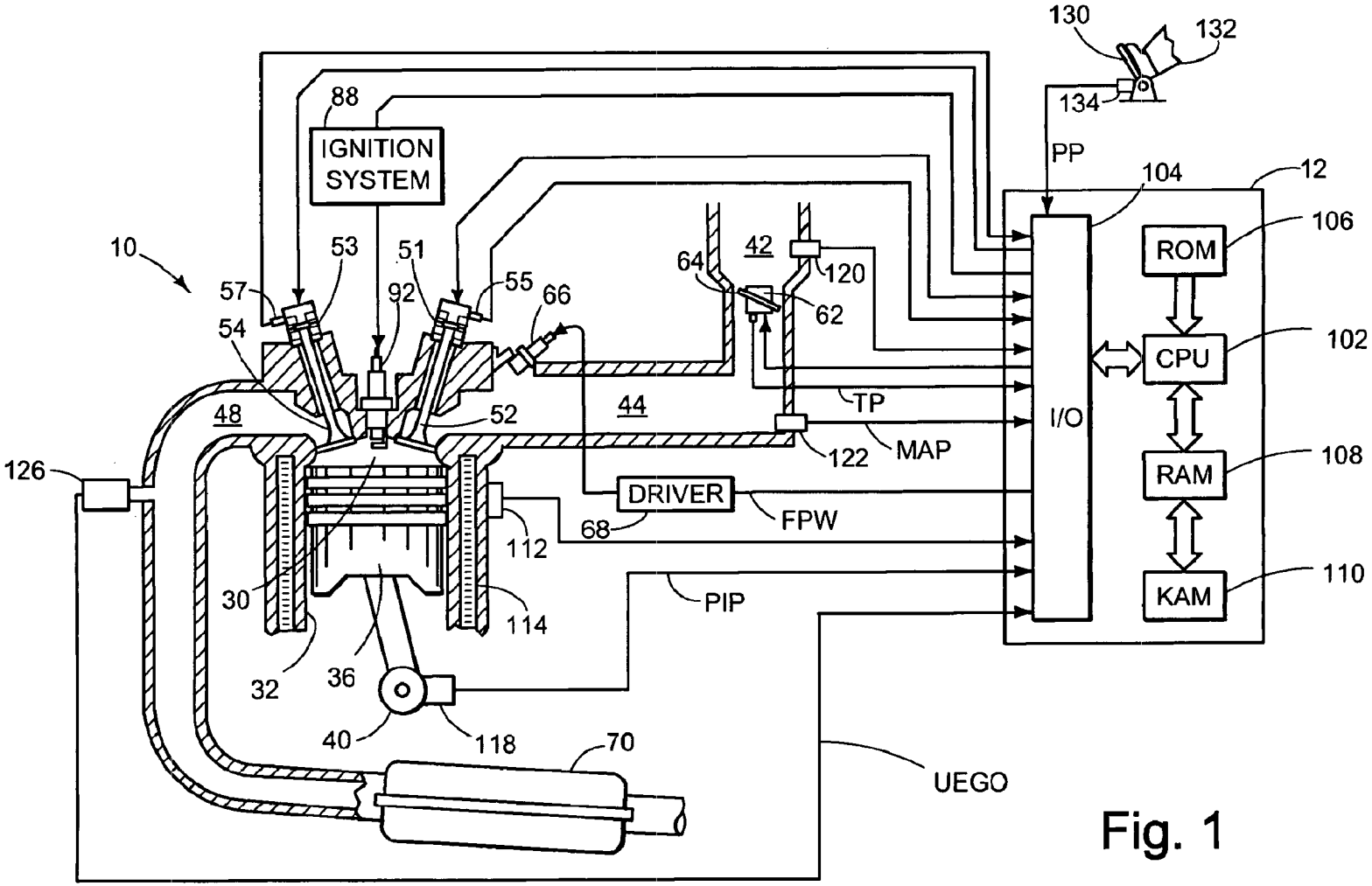
FIG. 1 is a schematic diagram of an engine.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 10 may include combustion chamber walls 32 with piston 36 positioned therein. Piston 36 may be coupled to crankshaft 40 so that reciprocating motion of the piston is translated into rotational motion of the crankshaft 40. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 12 via electric valve actuator (EVA) 51. Similarly, exhaust valve 54 may be controlled by controller 12 via EVA 53. During some conditions, controller 12 may vary the signals provided to actuators 51 and 53 to control the opening and closing of the respective intake and exhaust valves. The position of intake valve 52 and exhaust valve 54 may be determined by valve position sensors 55 and 57, respectively, which indicate displacement of the valve along an axis of the actuator (see FIG. 2). As another example, combustion chamber 30 may include an intake valve controlled via electric valve actuation and an exhaust valve controlled via cam actuation including cam profile switching (CPS) and/or variable cam timing (VCT).

Fuel injector 66 is shown arranged in intake passage 42 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from pressure sensor 122. Engine speed signal, RPM, may be generated by controller 12 from signal PIP. Manifold pressure signal MAP from a manifold pressure sensor may be used to provide an indication of vacuum, or pressure, in the intake manifold. In one example, sensor 118, which is also used as an engine speed sensor, may produce a predetermined number of equally spaced pulses every revolution of the crankshaft thereby indicating crankshaft position.

Storage medium read only memory 106 can be programmed with computer readable data representing instructions executable by microprocessor unit 102 for performing various methods or routines.

As described above, FIG. 1 shows one cylinder of a multi-cylinder engine, and each cylinder may similarly include its own set of intake/exhaust valves, valve position sensor(s), fuel injector, spark plug, etc.

Figure 2:
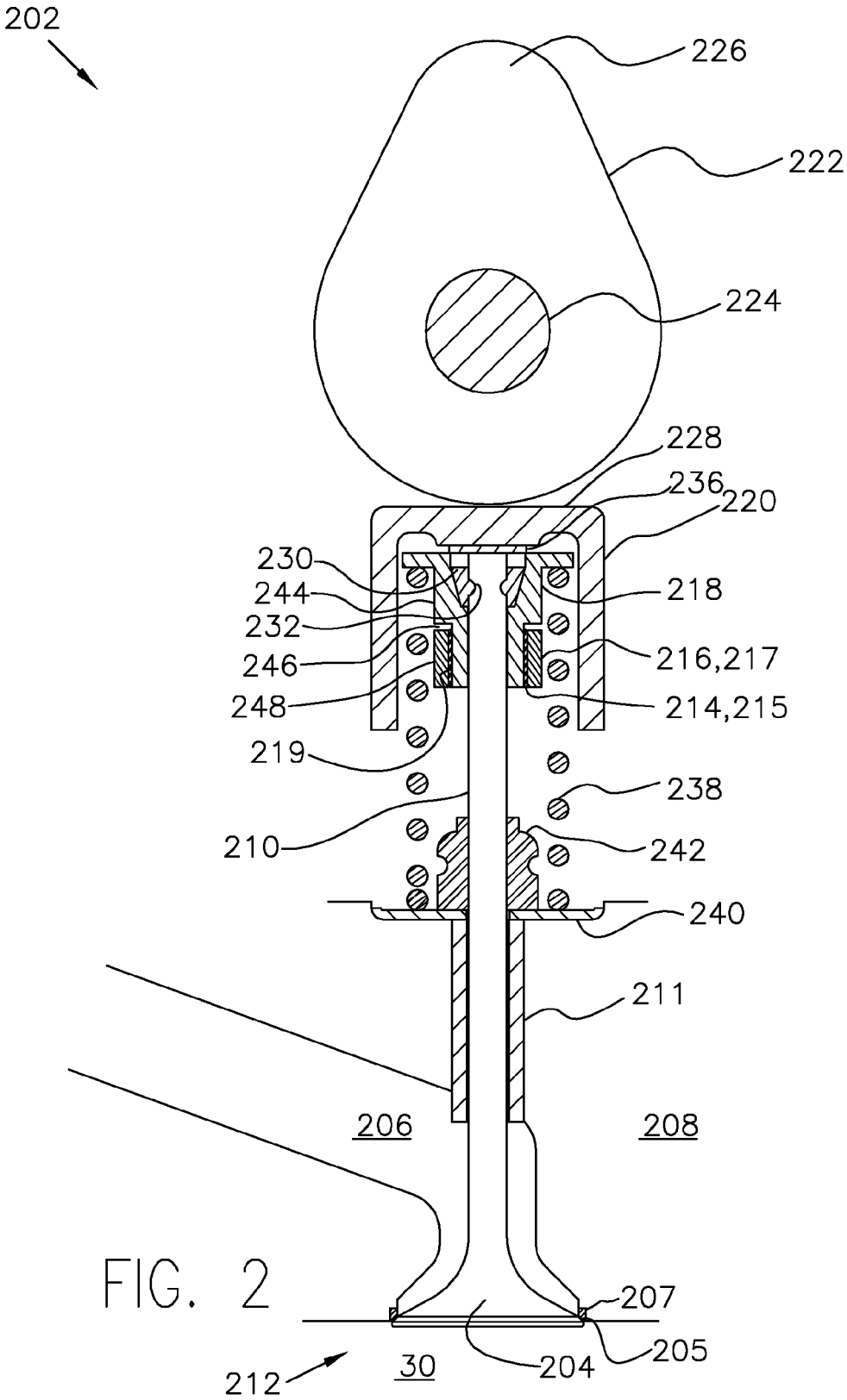
FIG. 2 is a cross-sectional view of an example valve train that may be used with the engine illustrated in FIG. 1 in accordance with the present disclosure.

FIG. 2 is a cross-sectional view of an example valve train 202 in accordance with the present disclosure. The valve train 202 may include, for example, the intake valve 52, or the exhaust valve 54 that may be used with the engine 10 illustrated in FIG. 1, or another engine. The valve illustrated in FIG. 2 may be referred to generally as valve 204. The valve 204 may be configured for movement within a passage 206. The passage 206 may be, for example, an intake passage 42, or an exhaust passage 48 that may be used with the engine 10 illustrated in FIG. 1, or another engine. The valve 204 may move to open and close the passage 206 to respectively allow a fluid to pass through the passage 206, or to substantially prevent a fluid from passing through the passage 206, and into, or out of, the combustion chamber 30. The valve 204 is shown in a closed position wherein a valve face 205 may be in contact with a valve seat, and in the illustrated example in contact with a valve seat insert 207. The passage 206 may be formed in, or coupled with, a cylinder head 208. The cylinder head 208 may sit above a cylinder block (not shown). The combustion chamber 30 may be formed at least partially in the cylinder block which may be closed at one end with the cylinder head 208.

The valve train 202 may support the valve 204 at an end of a valve stem 210, and may be configured for reciprocating movement within a valve guide 211 to cause the valve 204 to open and close a port 212 in the combustion chamber 30 of the engine 10. An elastomeric element 214 may be coupled with the valve stem 210. A mass 216 may be coupled with the elastomeric element 214 and may be able to move relative to the valve stem 210. In this way the mass 216 may tend to mitigate high frequency impact forces, and/or to absorb impact transient forces, which may be effective for a wide range of tick frequencies, for example frequencies above 1000 Hz. The valve train configuration may also, or instead, be effective for wide temperature variations, for example, from 0 F. degrees to 200 F. degrees.

In some embodiments the valve train 202 may include a valve retainer 218 fixed to the valve stem 210. The valve retainer 218 may be disposed within a tappet 220 and may be coupled with the valve stem 210 with a keeper 230. The valve stem 210 may include a keyway 232, or the like, to facilitate coupling the keeper 230 to the valve stem 210. A shim 234 may be located between the tappet 220 and an end 236 of the valve stem 210. The shim 234 may serve as a means to adjust an overall length of the valve train 202.

A cam 222 may be configured on a rotatable camshaft 224, and to hit a top 228 of the tappet 220 with each rotation. The hit and/or continued movement of the cam 222 may actuate general movement of the valve train 202 including the opening and closing movement of the valve 204. The valve may be biased toward a closed position with a bias such as spring 238. The spring 238 may be supported by a valve platform, or spring support 240. The spring support 240 may also support, or be adjacent to, a valve seal 242 which may serve to seal the volume above the cylinder head 208 from the combustion chamber 30.

In some cases, such as the one illustrated in FIG. 2, the elastomeric element 214 may be an annular ring encircling at least a portion of the valve retainer 218. The mass 216 may be an annular ring encircling at least a portion of the elastomeric element 214. In this way, various transient movements and/or vibrations that may otherwise accompany the general movement of the valve train 202 may be reduced. In this way a level of tick noises produced by the valve train may also be reduced. Also in this way, at least a portion of the impact energy from the valve closing and transferred impact force from tappet to the valve stem during the impact of the shaft lobe with the tappet may be absorbed which may tend to absorb impact transient forces and reduce un-wanted tick noises. In various embodiments the effectiveness of the valve train 202 in reducing unwanted noises may be modified by adjusting a combination of the elastomeric stiffness of the elastomeric element 214 and one or more characteristics of the mass 216 such as its weight.

Figure 3:
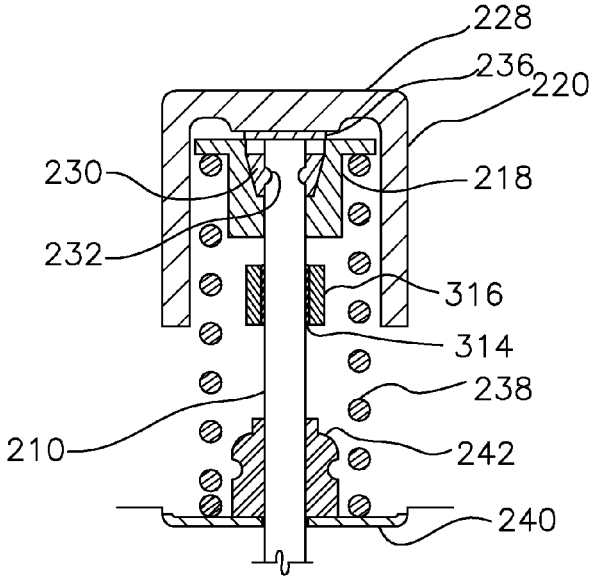
FIG. 3 is a cross-sectional view of another example valve train that may be used with the engine illustrated in FIG. 1 in accordance with the present disclosure.

In the example illustrated in FIG. 2 the elastomeric element 214 is shown to be in contact with the valve stem via a valve retainer fixed to the valve stem, and the mass is shown to be in direct contact with the elastomeric element but in indirect contact with the valve retainer 218. FIG. 3 is a cross-sectional view of another example valve train 202 in accordance with the present disclosure. In this example an elastomeric element 314 may be in direct contact with the valve stem 210, and a mass 316 may be in direct contact with the elastomeric element but in indirect contact with the valve stem 210.

Various example embodiments may provide a valve train 202 for an engine 10 that may include a valve stem 210 of a valve 204 movable to open and close a port 212 to a combustion chamber 30 of the engine 10. The valve train 202 may include a mass 216, 316 coupled with the valve stem 210 via a resilient member 214, 314.

Referring again to FIG. 2, some examples may provide a valve train 202 including a valve retainer 218 fixed to the valve stem 210. The valve retainer 218 may have an annular coupling surface 219. The resilient member 214 may be an elastomeric ring 215 fitted over the annular coupling surface 219 and the mass 216 may being an annular ring 217 compressed over the elastomeric ring 215.

In some examples the valve retainer 218 may also include an annular non-coupling surface 244 radially and longitudinally offset from the annular coupling surface 219. An annular gap 246 may be located between the mass 216 and the non-coupling surface 244. The mass 216 may have an outer annular surface 248 substantially radially inline with the non-coupling surface 244.

Figure 4:
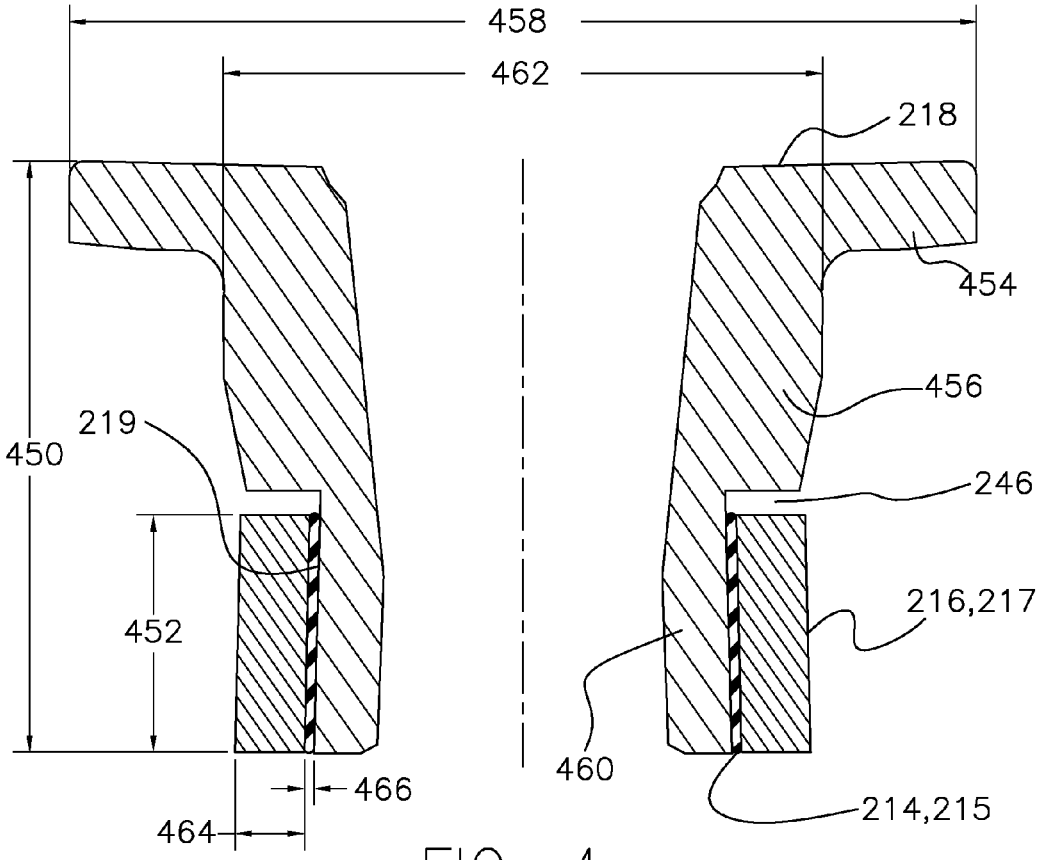
FIG. 4 is a cross-sectional view of an example valve retainer that may be included with one of the valve trains illustrated in FIGS. 2 and 3, or another valve train.

FIG. 4 is an expanded cross-sectional view of an example valve retainer 218 in accordance with the present disclosure. The valve retainer 218 may be used with, for example, the valve train 202 illustrated in FIG. 2. The valve retainer 218 may include a coupling surface 219. An elastomeric element 214 may be fixed to the coupling surface 219. A mass 216 may be over the elastomeric element 214.

The coupling surface 219 may be a substantially annular coupling surface 219, and the elastomeric element 214 may be an elastomeric ring over the substantially annular coupling surface 219. The mass 216 may be a metal annular ring 217 over the elastomeric ring 215. In some cases the metal annular ring 217 may at least partially compress the elastomeric ring 215.

The valve retainer 218 may have an axial length 450. The annular coupling surface 219 may have a coupling length 452 approximately one half as long as the axial length 450.

The valve retainer 218 may include an annular flange 454. A first annular body portion 456 may extend from the annular flange 454 and may have a first diameter 458. A second annular body portion 460 may extend from the first annular body portion 456. The second annular body portion 460 may have a second diameter 462 which may be smaller than the first diameter 458. The annular coupling surface 219 may be an outer annular surface of the second annular body portion 460. The elastomeric element 214 may be an elastomeric ring 215 around the annular coupling surface 219. The mass 216 may be an annular ring 217 at least partially compressing the elastomeric ring 215 over the annular coupling surface 219. The valve retainer 218 may also include an annular gap 246 between the first annular body portion 456 and the mass 216.

In some embodiments the mass 216 may be between 1.2 grams and 2.0 grams. In some cases the mass 216 may be approximately 1.6 grams. The mass 216 may have a longitudinal length of from 3 to 7 mm. In some cases the mass 216 may have a longitudinal length of approximately 5 mm.

In some embodiments the mass 216 may be approximately 4 times thicker than the elastomeric ring 215 in a radial direction. In some cases the mass 216 may have a mass thickness 464 of from 1.0 to 1.6 mm, and the elastomeric element 214 may have an elastomeric thickness 466 of from 0.1 mm to 0.5 mm. The mass 216 may have a mass thickness 464 of approximately 1.3 mm. The elastomeric element 214 may have an elastomeric thickness 466 of approximately 0.3 mm.

It should be understood that the arrangements, systems, and methods described herein are examples, and that these specific embodiments are not to be considered in a limiting sense, because numerous variations are contemplated. Accordingly, the present disclosure includes all novel and non-obvious combinations of the various arrangements, systems, and methods disclosed herein, as well as any and all equivalents thereof.

The invention claimed is:

1. A valve train for an engine comprising:

a valve including a valve stem configured for reciprocating movement to open and close a port in a combustion chamber of the engine;

a spring holding the valve biased toward a closed position;

an elastomeric element coupled with the valve stem and located within the spring; and a mass coupled with the elastomeric element and able to move relative to the valve stem, wherein the elastomeric element is in contact with the valve stem via a valve retainer fixed to the valve stem, the mass is in direct contact with the elastomeric element but in indirect contact with the valve retainer, a top end of the mass is below a top end of the spring, and a bottom end of the mass is above a bottom end of the spring.

2. The valve train of claim 1, further comprising a valve retainer fixed to the valve stem, and wherein the elastomeric element is an annular ring encircling at least a portion of the valve retainer, and wherein the mass is an annular ring encircling at least a portion of the elastomeric element.

3. The valve retainer of claim 1, wherein the mass is between 1.2 grams and 2.0 grams.

4. The valve retainer of claim 1, wherein the mass is approximately 1.6 grams.

5. The valve retainer of claim 1, wherein the mass has a longitudinal length of from 3 to 7 mm.

6. The valve retainer of claim 1, wherein the mass has a longitudinal length of approximately 5 mm.

7. The valve retainer of claim 1, wherein the mass is approximately 4 times thicker than the elastomeric ring in a radial direction.

8. The valve retainer of claim 1, wherein the mass has a thickness of from 1.0 to 1.6 mm.

9. The valve retainer of claim 1, wherein the elastomeric element has a thickness of from 0.1 mm to 0.5 mm.

10. The valve retainer of claim 1, wherein the mass has a thickness of approximately 1.3 mm.

11. The valve retainer of claim 1, wherein the elastomeric element has a thickness of approximately 0.3 mm.

12. A valve train for an engine comprising:

a valve including a valve stem configured for reciprocating movement to open and close a port in a combustion chamber of the engine;

a spring holding the valve biased toward a closed position;

an elastomeric element coupled with the valve stem and located within the spring; and a mass coupled with the elastomeric element and able to move relative to the valve stem, wherein the elastomeric element is in direct contact with the valve stem, and the mass is in direct contact with the elastomeric element but in indirect contact with the valve stem.

13. A valve train comprising:

a valve including a valve stem of an intake valve movable to open and close a port to an engine combustion chamber;

a spring holding the valve biased toward a closed position; and a mass coupled with the valve stem via a resilient member, located within the spring, the mass having a top end below a top end of the spring and a bottom end above a bottom end of the spring.

14. The valve train of claim 13, further comprising a valve retainer fixed to the valve stem, the valve retainer having an annular coupling surface, the resilient member being an elastomeric ring fitted over the annular coupling surface and the mass being an annular ring compressed over the elastomeric ring, wherein the valve retainer further comprises an annular non-coupling surface radially and longitudinally offset from the annular coupling surface, further comprising an annular gap between the mass and the non-coupling surface, wherein the mass has an outer annular surface substantially radially inline with the non-coupling surface.

* * * * *